US009350142B2

(12) United States Patent
Obe

(10) Patent No.: US 9,350,142 B2
(45) Date of Patent: May 24, 2016

(54) SIGNAL DETECTION CIRCUIT, IGNITER, AND VEHICLE USING THE SAME

(71) Applicant: Rohm Co., Ltd., Kyoto (JP)

(72) Inventor: Katsuya Obe, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 247 days.

(21) Appl. No.: 14/018,749

(22) Filed: Sep. 5, 2013

(65) Prior Publication Data

US 2014/0062324 A1 Mar. 6, 2014

(30) Foreign Application Priority Data

Sep. 6, 2012 (JP) ..... 2012-195767

(51) Int. Cl.
*H01T 15/00* (2006.01)
*F02P 3/04* (2006.01)
*F02P 11/00* (2006.01)

(52) U.S. Cl.
CPC ..... *H01T 15/00* (2013.01); *F02P 3/0435* (2013.01); *F02P 11/00* (2013.01)

(58) Field of Classification Search
USPC ..... 361/253
See application file for complete search history.

(56) References Cited

U.S. PATENT DOCUMENTS 5,347,855 A * 9/1994 Miyata et al. ..... 73/114.08
5,349,299 A * 9/1994 Kanehiro ..... F02P 17/12 123/479
5,493,227 A * 2/1996 Shimasaki et al. ..... 324/378
5,668,384 A * 9/1997 Murakami ..... 257/106
5,740,025 A * 4/1998 Siegling, III ..... B60M 1/02 191/37
5,852,381 A * 12/1998 Wilmot et al. ..... 327/440
5,886,504 A * 3/1999 Scott ..... B23K 9/1062 322/15
6,014,325 A * 1/2000 Pecore ..... F25D 29/00 323/908
7,005,855 B2 * 2/2006 Zhu et al. ..... 324/380
8,582,263 B2 * 11/2013 Butler ..... H03F 1/52 361/91.1
9,013,856 B2 * 4/2015 Mahajan et al. ..... 361/256
2001/0023962 A1 * 9/2001 Pasqualini ..... 257/355
2001/0041548 A1 * 11/2001 Bult et al. ..... 455/252.1
2002/0066444 A1 * 6/2002 Ikeda et al. ..... 123/606
2002/0093339 A1 * 7/2002 Ishida et al. ..... 324/382
2002/0170548 A1 * 11/2002 Masters et al. ..... 123/641
2003/0164025 A1 * 9/2003 Kiess et al. ..... 73/35.08
2003/0168049 A1 * 9/2003 Zarkhin et al. ..... 123/609
2006/0027219 A1 * 2/2006 Ando ..... 123/618
2007/0064371 A1 * 3/2007 Salerno ..... 361/113
2010/0214704 A1 * 8/2010 Lamey et al. ..... 361/56
2011/0090604 A1 * 4/2011 Butler ..... H03F 1/52 361/18
2011/0234096 A1 * 9/2011 Asmussen et al. ..... 315/53
2014/0015005 A1 * 1/2014 Ishii ..... F02P 11/00 257/139
2014/0210007 A1 * 7/2014 Deval et al. ..... 257/350
2014/0361841 A1 * 12/2014 Sawada et al. ..... 331/18

FOREIGN PATENT DOCUMENTS

JP 2011-185163 9/2011

* cited by examiner

*Primary Examiner* — Thienvu Tran
*Assistant Examiner* — Angela Brooks
(74) *Attorney, Agent, or Firm* — Fish & Richardson P.C.

(57) ABSTRACT

There are provided a signal detection circuit and an igniter capable of enhancing a capability of withstanding breakdown by noise. The signal detection circuit includes an input terminal Sin configured to receive a control signal from an ECU and a bidirectional floating diode provided between the input terminal and a ground. Further, the signal detection circuit includes an attenuation circuit configured to attenuate an output of the bidirectional floating diode, a low-pass filter configured to pass a low-frequency component of the output of the attenuation circuit, and a comparator configured to compare an output of the low-pass filter with a reference voltage.

13 Claims, 22 Drawing Sheets

BVsub > BV1 +Vf2
BVsub > BV2 +Vf1

10d

SIGNAL DETECTION CIRCUIT, IGNITER, AND VEHICLE USING THE SAME

CROSS-REFERENCE TO RELATED APPLICATIONS

This application is based upon and claims the benefit of Japanese Patent Application No. 2012-195767, filed on Sep. 6, 2012, the entire contents of which is incorporated herein by reference.

TECHNICAL FIELD

The present disclosure relates to a signal detection circuit for detecting a control signal from an engine control unit (ECU), an igniter using the signal detection circuit and a vehicle using the igniter.

BACKGROUND

Since an igniter is used in an engine room, various surges and noises affect the operation of the igniter. Therefore, many tests are performed for the igniter.

For example, a test using a bulk current injection (BCI) or a Giga-hertz transverse electromagnetic (GTEM) cell is well known.

When noise is applied to an input terminal of a signal detection circuit of the igniter for receiving a control signal from the ECU, the signal detection circuit may not correctly detect the control signal from the ECU, thereby causing a malfunction of the igniter.

SUMMARY

The present disclosure provides a signal detection circuit capable of enhancing the capability for withstanding a malfunction due to noise and an igniter using the same.

According to an embodiment of the present disclosure, there is provided a signal detection circuit for detecting a control signal from an engine control unit. The signal detection circuit includes: an input terminal configured to receive the control signal; a bidirectional floating diode provided between the input terminal and a ground; an attenuation circuit configured to attenuate an output of the bidirectional floating diode; a low-pass filter configured to pass a low-frequency component of an output of the attenuation circuit; and a comparator configured to compare an output of the low-pass filter with a reference voltage.

According to another embodiment of the present disclosure, there is provided an igniter for controlling an operation of a spark plug based on a control signal from an engine control unit. The igniter includes: a switch control unit having a signal detection circuit configured to detect the control signal; an ignition coil configured to generate a voltage to be supplied to the spark plug; and a switch element configured to apply or cut current, which flows to the ignition coil, based on an output of the switch control device, wherein the signal detection circuit includes a bidirectional floating diode for electrostatic protection.

BRIEF DESCRIPTION OF THE DRAWINGS

FIGS. 6A and 6B is schematic waveform diagrams in the signal detection circuit according to the comparative example, wherein FIG. 6A shows a noise waveform diagram and FIG. 6B shows an input waveform diagram.

FIGS. 18A and 18B show diagrams illustrating a bidirectional floating diode according to the embodiment, wherein FIG. 18A shows a schematic cross-sectional structure diagram and FIG. 18B shows an equivalent circuit diagram.

FIGS. 19A and 19B show diagrams illustrating a bidirectional floating diode according to another embodiment, wherein FIG. 19A shows a schematic cross-sectional structure diagram and FIG. 19B shows an equivalent circuit diagram.

FIGS. 20A and 20B show schematic waveform diagrams in the signal detection circuit according to the embodiment, wherein FIG. 20A shows a noise waveform diagram and FIG. 20B shows an input waveform diagram.

FIGS. 21A and 21B show schematic waveform diagrams in the signal detection circuit according to the embodiment, wherein FIG. 21A is a waveform diagram showing a state where envelope detection is not performed, and FIG. 21B is a waveform showing a state where the control signal is accurately detected.

DETAILED DESCRIPTION

Figure 1:
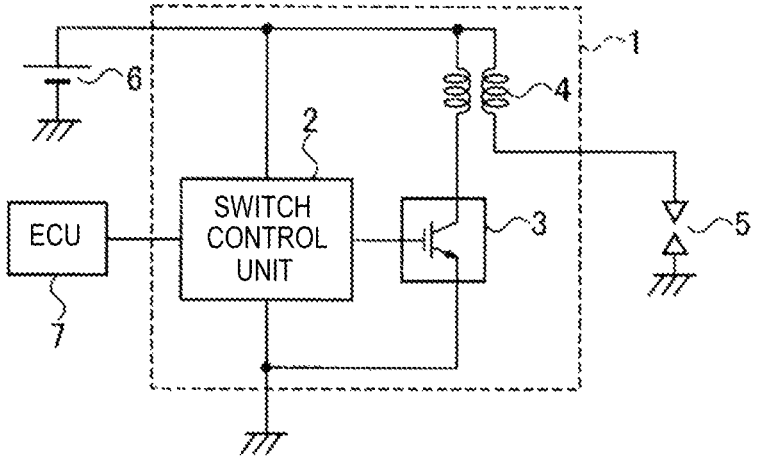
FIG. 1 shows a schematic block diagram of an igniter according to the embodiment.

Next, embodiments of the present disclosure will be described with reference to drawings. In the description of the following drawings, the identical or similar reference numeral is attached to the identical or similar part. However, it should be known about that the drawings are schematic and the relation between thickness and the plane size of each component part, and the ratio of the thickness of each layer differs from an actual thing. Therefore, detailed thickness and size should be determined in consideration of the following explanation. Of course, the part from which the relation and ratio of a mutual size differ also in mutually drawings is included.

Moreover, the embodiments shown hereinafter exemplify the apparatus and method for materializing the technical idea of the present disclosure, and the embodiments of the present disclosure does not specify the material, shape, structure, placement, etc. of component parts as the following. Various changes can be added to the technical idea of the present disclosure in scope of claims.

A detailed description of the present disclosure will be provided with reference to FIGS. 1 to 21.

(Configuration of Igniter)

FIG. 1 shows a schematic block diagram of an igniter 1 according to the embodiment of the present disclosure. As shown in FIG. 1, the igniter 1 includes a switch control unit 2, a switch element 3 and an ignition coil 4. The igniter 1 controls an operation of a spark plug 5 based on a control signal from an engine control unit (ECU) 7.

Figure 2:
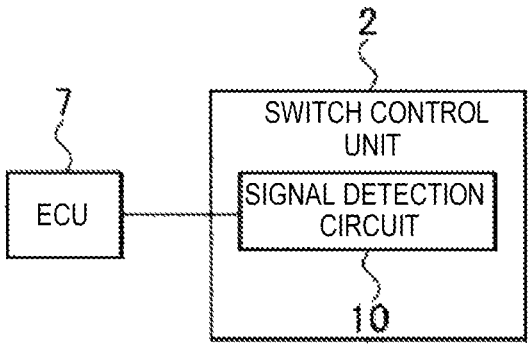
FIG. 2 shows a schematic block diagram of a switch control unit including a signal detection circuit connected to an ECU.

FIG. 2 shows a schematic block diagram of the switch control unit 2. As shown in FIG. 2, the switch control unit 2 includes a signal detection circuit 10 configured to detect the control signal from the ECU 7. The signal detection circuit 10 included in the switch control unit 2 is connected to the ECU 7. More particularly, the switch control unit 2 may be an insulated gate bipolar transistor (IGBT) gate driver.

Referring back to FIG. 1, the switch element 3 is an element for applying and cutting a current, which flows to the ignition coil 4, based on an output of the switch control unit 2. More particularly, the switch element 3 may be the IGBT. The ignition coil 4 is a transformer configured to generate a voltage to be supplied to the spark plug 5.

A power supply such as a car battery 6 is connected to one end of a primary coil of the ignition coil 4, and the switch element 3 is connected to the other end of the primary coil of the ignition coil 4. Also, the power supply such as the car battery 6 is connected to one end of a secondary coil of the ignition coil 4 similar to the primary coil, and the spark plug 5 is connected to the other end of the secondary coil of the ignition coil 4. For example, the ignition coil 4 boosts the voltage of the car battery 6 of 12V~15V up to 20,000~30,000 V, and supplies 20,000~30,000 V to the spark plug 5.

COMPARATIVE EXAMPLE

Figure 3:
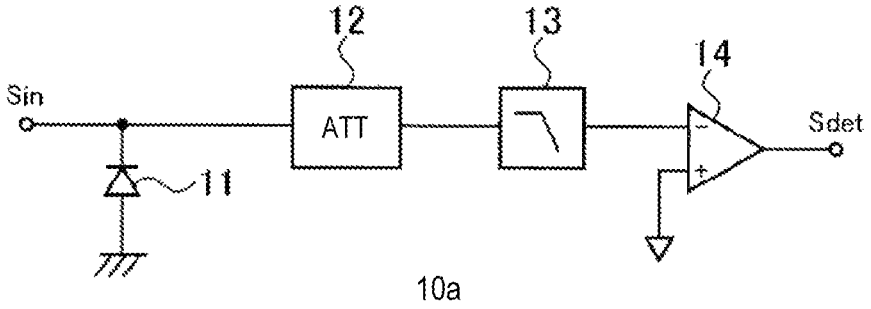
FIG. 3 shows a schematic block diagram of a signal detection circuit according to a comparative example.
Figure 4:
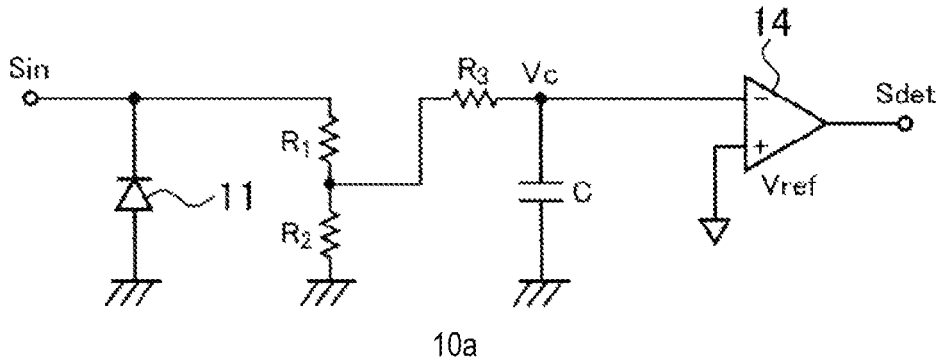
FIG. 4 shows a schematic circuit diagram of the signal detection circuit according to the comparative example.

FIG. 3 shows a schematic block diagram of a signal detection circuit 10*a* according to a comparative example. As shown in FIG. 3, the signal detection circuit 10*a* includes an ESD (electrostatic discharge) protection element 11, an attenuation circuit 12, a low-pass filter 13, and a comparator (hysteresis comparator) 14. With this configuration, the signal detection circuit 10*a* enhances the capability of withstanding the breakdown by a surge and prevents a malfunction due to noise. FIG. 4 shows a schematic circuit diagram of the signal detection circuit 10*a*. In FIG. 4, resistors $R_1$ and $R_2$ correspond to the attenuation circuit 12 in FIG. 3. A resistor R3 and a capacitor C in FIG. 4 correspond to the low-pass filter 13 in FIG. 3. The comparator 24 compares an output of the low pass filter 13 with a reference voltage Vref. The signal detection circuit 10*a* shown in FIG. 4 may be an integrated circuit (for example, LSI circuit or Large Scale Integration circuit). In FIGS. 3 and 4, a reference numeral "Sin" represents an input terminal of the control signal from the ECU 7, and a reference numeral "Sdet" represents a determination output of the control signal from the ECU 7. In the below, the reference numeral "Sin" may also represent an input signal inputted to the input terminal.

Figure 5:
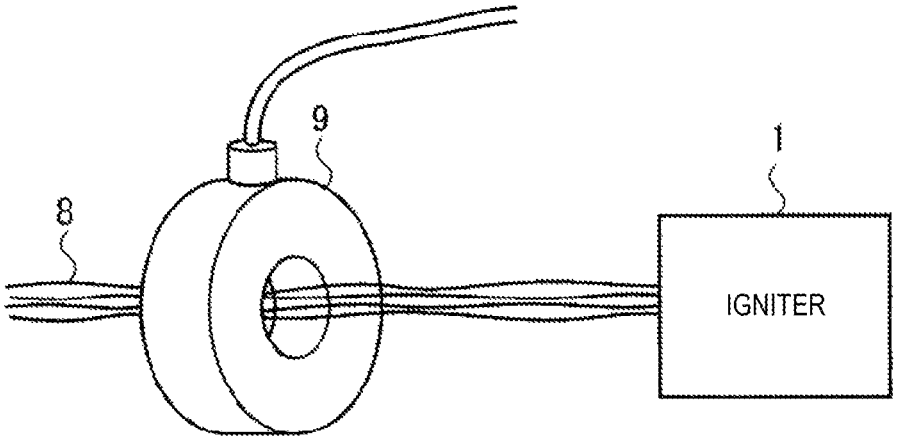
FIG. 5 is a diagram illustrating a BCI test.

Since the igniter 1 is used in an engine room of a car (not shown), various surges and noises affect the operation of the igniter 1. Therefore, many tests are performed for the igniter 1. For example, in the BCI test, a BCI probe 9 applies noise to a signal line 8 connected to the igniter 1 to conform whether the igniter 1 is influenced or not by the noise, as shown in FIG. 5.

Figure 6A:
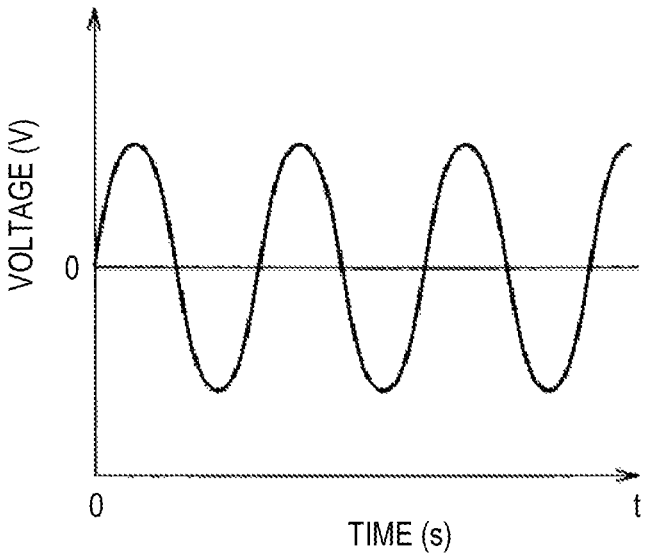
Figure 6B:
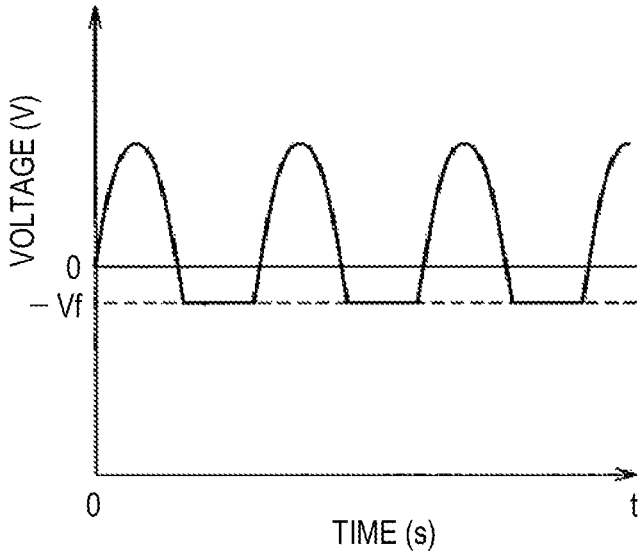
Figure 7:
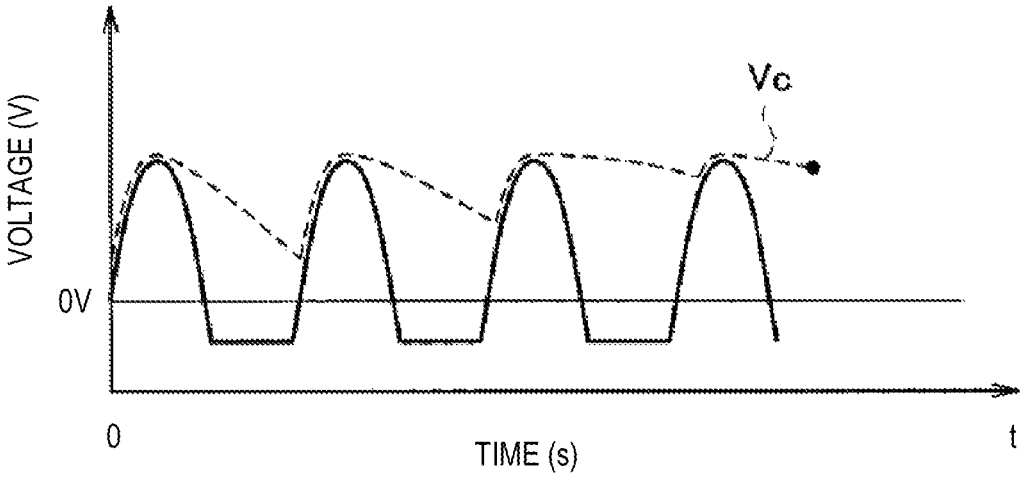
FIG. 7 is a schematic waveform diagram showing envelope detection in the signal detection circuit according to the comparative example.
Figure 8:
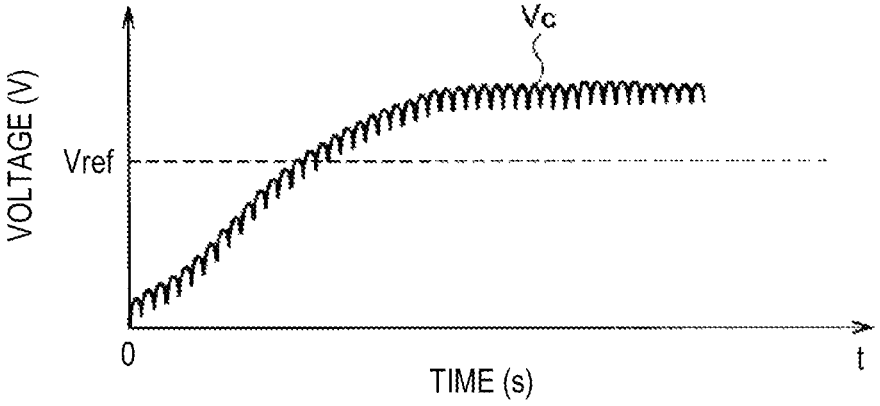
FIG. 8 is a schematic waveform diagram showing misidentification in the signal detection circuit according to the comparative example.

If only the input terminal Sin is influenced by the noise, it is assumed that the noise as shown in FIG. 6A is applied to the input terminal Sin. In this case, in the signal detection circuit 10*a* according to the comparative example, the noise applied to the input terminal Sin is clamped to a half-wave at a negative side by the forward clamping of the ESD protection element 11 and a parasitic PN junction, as shown in FIG. 6B. Thus, the balance of the charge/discharge of the capacitor C of the low-pass filter 13 is disturbed, and an envelope detection as shown in FIG. 7 is performed. Therefore, a peak-hold value Vc of the capacitor C may exceed the reference voltage Vref of the comparison circuit 14 as shown in FIG. 8. Thus, although the control signal from the ECU 7 is Low, there is a problem that the comparator 14 may misidentify the control signal as High due to the influence of the noise.

(Configuration of Signal Detection Circuit)

Figure 9:
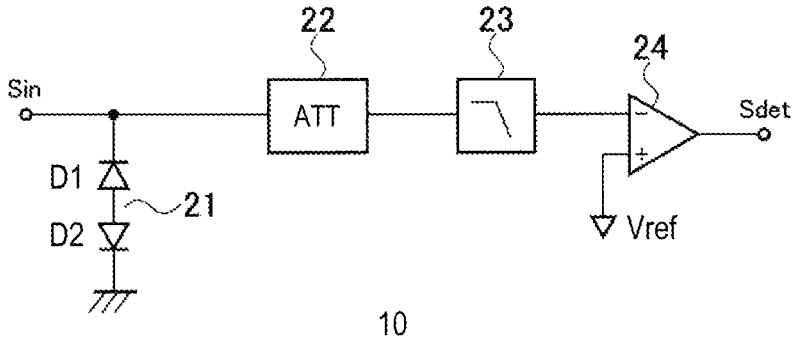
FIG. 9 shows a schematic block diagram of the signal detection circuit according to the embodiment.

FIG. 9 shows a schematic block diagram of the signal detection circuit 10 according to the embodiment of the present disclosure. The signal detection circuit 10 detects the control signal from the ECU 7. The signal detection circuit 10 includes an input terminal Sin configured to receive the control signal from the ECU 7, a bidirectional floating diode 21 provided between the input terminal Sin and a ground, an attenuation circuit 22 configured to attenuate an output of the bidirectional floating diode 21, a low-pas filter 23 configured to pass a low-frequency component of an output of the attenuation circuit 22, and a comparator 24 configured to compare an output of the low pass filter 23 with a reference voltage Vref.

It is possible that the bidirectional floating diode 21 has a structure in which anodes of diodes $D_1$ and $D_2$ each having a floating structure are connected to face each other.

It is also possible that the bidirectional floating diode 21 has a structure in which cathodes of diodes $D_3$ and $D_4$ (to be described later) having the floating structure are connected to face each other.

Further, the floating structure of the diodes $D_1$ to D4 may be obtained by forming an N type region that is disposed under a PN junction and is maintained in an open state.

Further, it is possible that positive and negative clamp trigger voltages of the bidirectional floating diode 21 are the same with respect to the input terminal Sin.

Further, it is possible that the comparator 24 includes a pair of NPN type bipolar transistors whose base terminals are connected together.

Further, it is possible that the low-pass filter 23 is a Sallen-key type low-pass filter having a predetermined number of stages (for example, N stages).

Further, it is possible that a reference voltage line of the comparator 24 includes a dummy circuit that has the same structure as a filter line of the low-pass filter 23.

In this embodiment, the input signal Sin is not influenced by the parasitic PN junction and is not clamped at the negative side by using the bidirectional floating diode 21 as the ESD protection element. Therefore, since the low pass filter 23 does hold the peak of the noise, it is possible that the comparator 24 can accurately detect the control signal form the ECU 7. Herein, the attenuation (dividing voltage) is performed by the attenuation circuit 22 in order to increase the detection accuracy. However, the attenuation circuit 22 may be omitted if an input dynamic range of the comparator 24 is sufficiently large.

(Circuit Configuration of Signal Detection Circuit)

Figure 10:
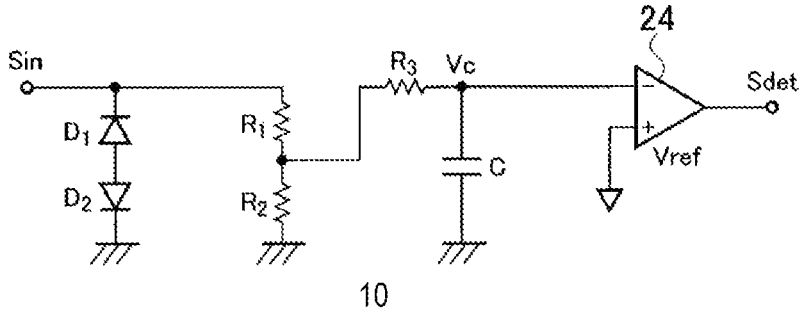
FIG. 10 shows a schematic circuit diagram of the signal detection circuit according to the embodiment.

FIG. 10 shows a schematic circuit diagram of the signal detection circuit 10 according to the embodiment of the present disclosure. The signal detection circuit 10 shown in FIG. 10 may be formed as an integrated circuit. As shown in FIG. 10, the bidirectional floating diode 21 includes the diodes $D_1$ and $D_2$. The diode $D_1$ is connected to the diode $D_2$ in series and a forward direction of the diode $D_1$ is different from that of the diode $D_2$. Each of the diodes $D_1$ and $D_2$ has a floating structure. The floating structure of the diodes $D_1$ and $D_2$ will be described later.

Figure 11:
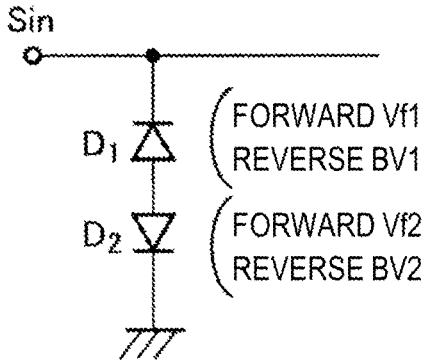
FIG. 11 is a diagram of illustrating a breakdown voltage of a bidirectional floating diode according to the embodiment.

FIG. 11 is a diagram for illustrating a breakdown voltage of the bidirectional floating diode 21 according to the embodiment of the present disclosure. The bidirectional floating diode 21 is configured so that a positive clamp trigger voltage BV1+Vf2 and a negative clamp trigger voltage BV2+Vf1 are the same with respect to the input terminal Sin. In this case, as shown in FIG. 11, BVsub (breakdown voltage) of the diode $D_1$ or $D_2$ is larger than the positive clamp trigger voltage BV1+Vf2 and the negative clamp trigger voltage BV2+Vf1.

Referring back to FIG. 10, the resistors $R_1$ and $R_2$ correspond to the attenuation circuit 22. The resistor R3 and the capacitor C correspond to the low-pass filter 23. The resistors $R_1$, $R_2$ and $R_3$ and the capacitor C are selected such that breakdown voltages of the resistors $R_1$, $R_2$ and $R_3$ and the capacitor C are larger than the clamp trigger voltage BV1+Vf2 so that a parasitic PN junction does not occur in any of the resistors $R_1$, $R_2$ and $R_3$ and the capacitor C. Since the PN structure must occur in elements (BJT or CMOS) constituting the comparator 24, the capacitor voltage Vc is attenuated to be within ±Vf by a divided voltage of the resistors $R_1$ and $R_2$.

An attenuation amount of the attenuation circuit 22 is determined such that the clamp at the negative side is not generated in the capacitor voltage Vc (i.e., the maximum amplitude Vppmax of the capacitor voltage Vc is within ±Vf). Therefore, the maximum amplitude Vppmax of the input signal Sin must be ±Vf (for example, in case of FIG. 11, ±16V). That is, 1/30 or more is attenuated by Vf/16V.

Figure 12:
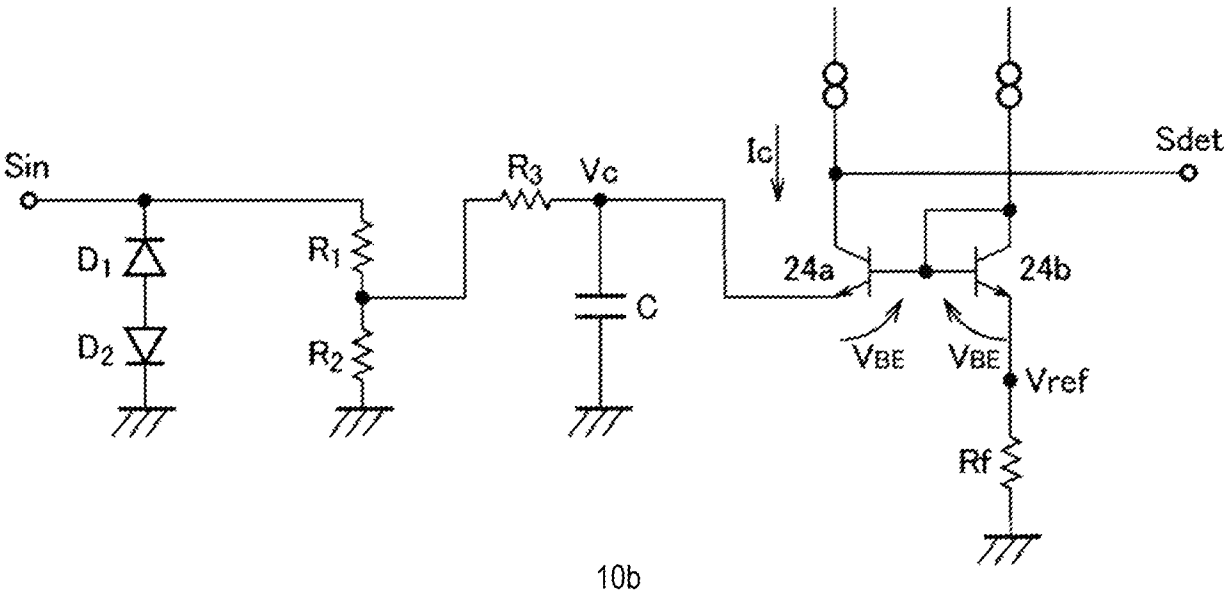
FIG. 12 is a schematic circuit diagram showing a signal detection circuit according to another embodiment.
Figure 13:
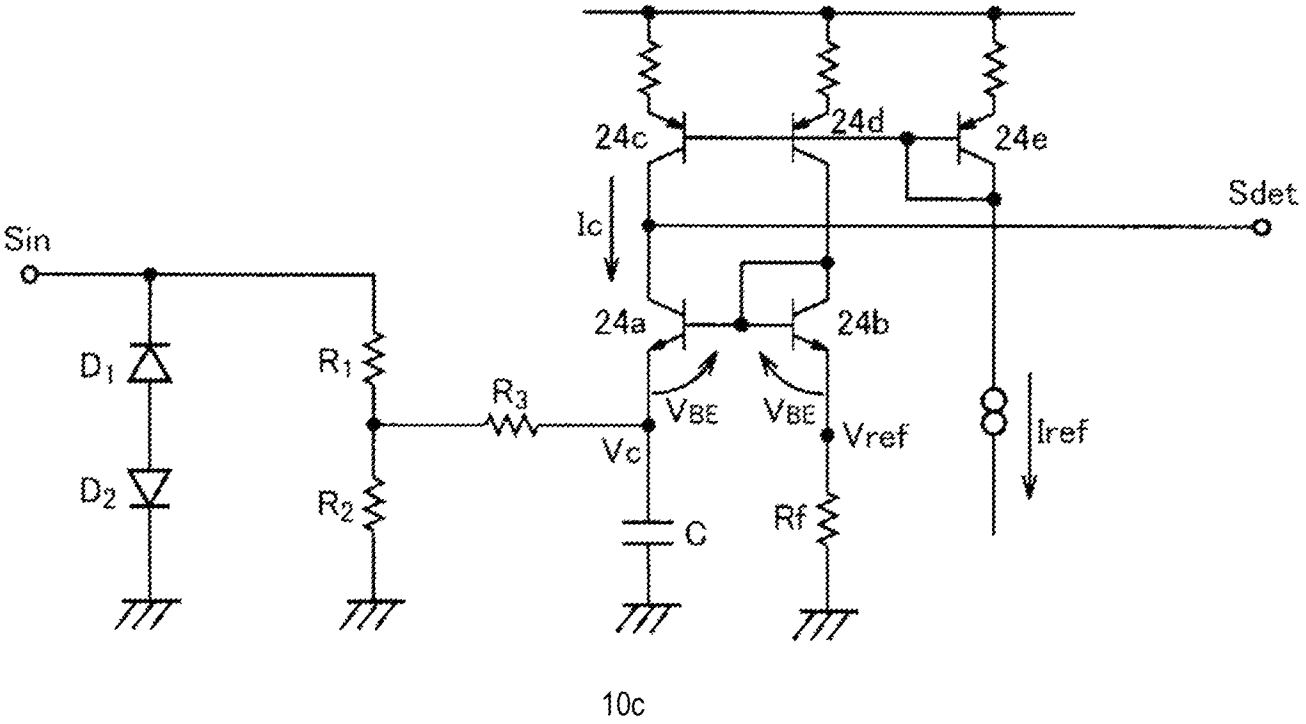
FIG. 13 is a schematic circuit diagram showing a signal detection circuit according to yet another embodiment.

Since a threshold value of the control signal from the ECU 7 is usually about several voltages, the comparator 24 must detect the voltage of several tens mV for the above-described attenuation amount. FIG. 12 is a schematic circuit diagram showing a signal detection circuit 10*b* according to another embodiment of the present disclosure. A comparator shown in FIG. 12 includes a pair of NPN type bipolar transistors 24*a* and 24*b* whose base terminals are connected together. As shown in FIG. 12, the comparator uses a difference between a collector current Ic and a base-emitter voltage $V_{BE}$ (i.e., $Ic-V_{BE}$). FIG. 13 is a schematic circuit diagram showing a signal detection circuit 10*c* according to yet another embodiment of the present disclosure. A comparator shown in FIG. 13 includes a mirror circuits 24*c* and 24*d* in addition to bipolar transistors 24*a* and 24*b*. As shown in FIG. 13, it is possible to generate the collector current Ic by using the mirror circuits 24*c* and 24*d*. Since the collector current Ic can flow while the base-emitter voltage $V_{BE}$ is maintained, the determination output Sdet becomes High. Meanwhile, if the base-emitter voltage $V_{BE}$ is not maintained, since the collector current Ic does not flow, the determination output Sdet becomes Low. With this configuration, the comparator may accurately detect the voltage, which is lower than about several tens mV.

Figure 14:
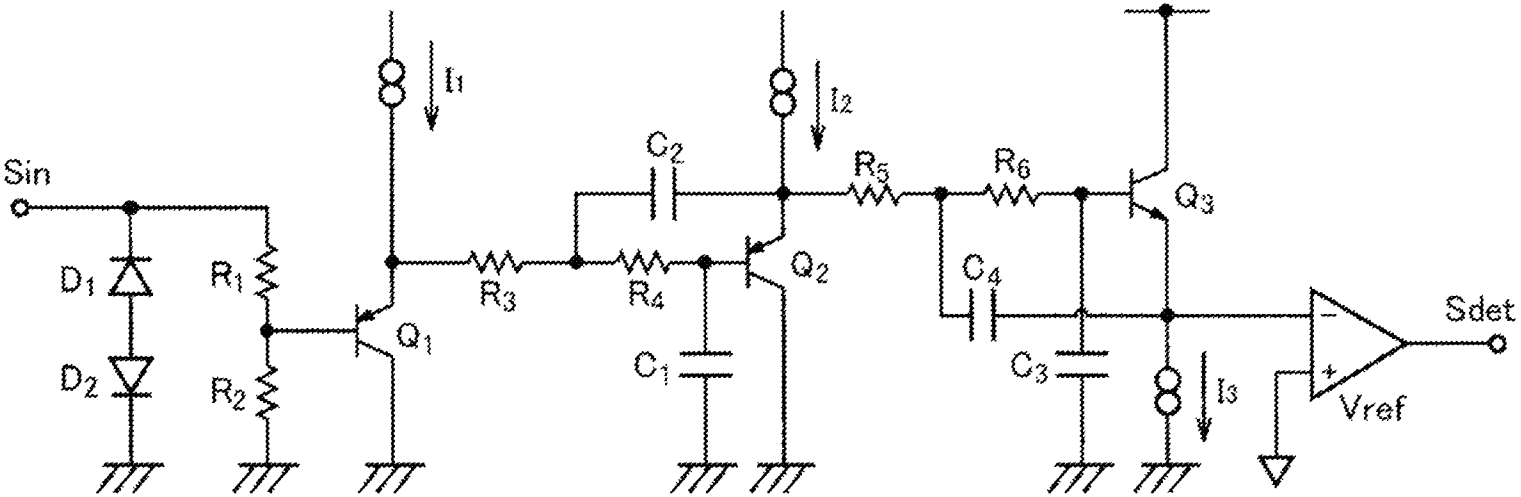
FIG. 14 is a schematic circuit diagram of a signal detection circuit according to yet another embodiment.

FIG. 14 is a schematic circuit diagram of a signal detection circuit 10*d* according to yet another embodiment of the present disclosure. When a noise attenuation amount is not sufficient with a time constant of $R_3 \cdot C$ or when a timing of the control signal is delayed with $R_3 \cdot C$ (i.e., when $C \times R_3 = \tau$ is too large), it is also possible to insert a Salen-key type low-pass filter of two stages. As shown in FIG. 14, a first stage of the Sallen-key type low-pass filter is formed by registers $R_3$ and $R_4$, capacitors $C_1$ and $C_2$, and a PNP transistor $Q_2$. Also, a second stage of the Sallen-key type low-pass filter is formed by registers $R_5$ and $R_6$, capacitors $C_3$ and $C_4$, and a NPN transistor $Q_3$.

Figure 15:
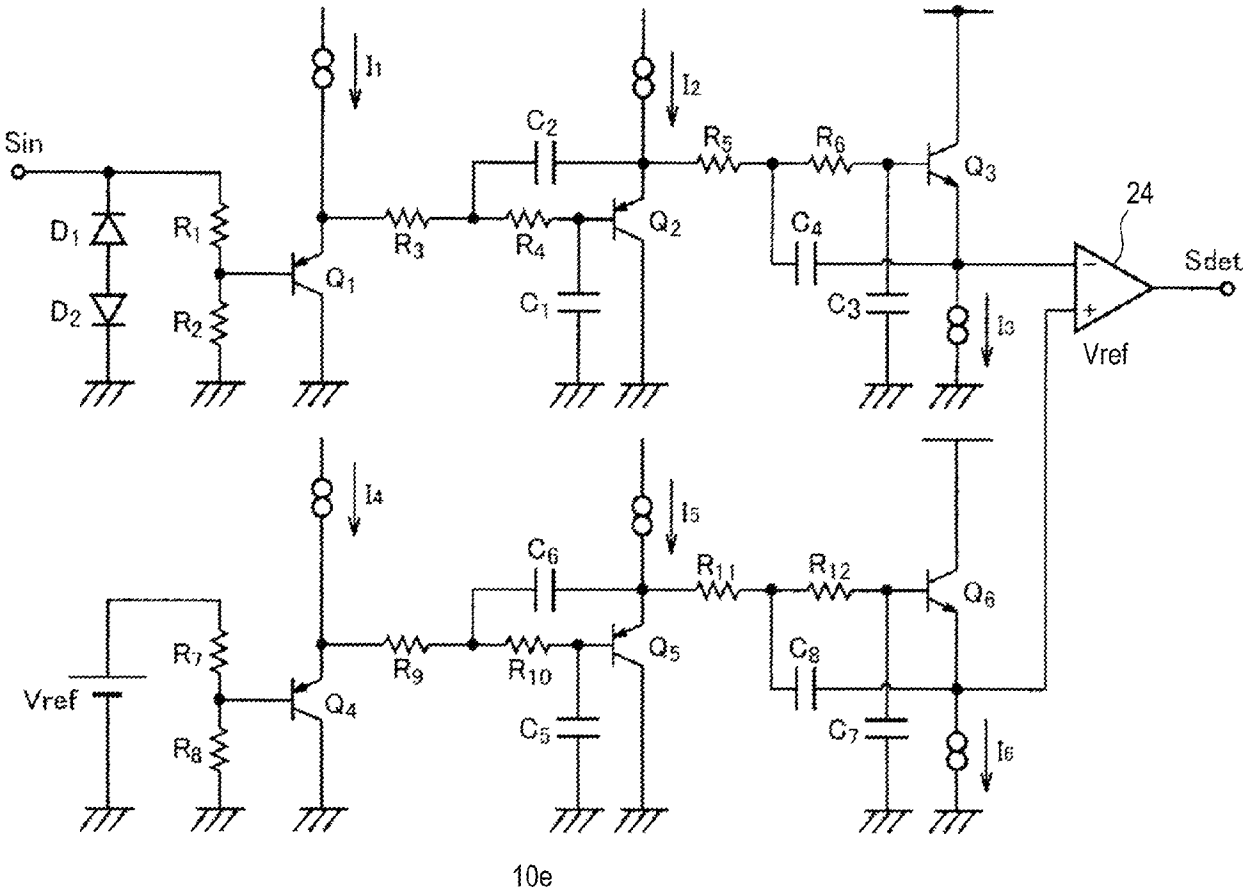
FIG. 15 is a schematic circuit diagram of a signal detection circuit according to yet another embodiment.

Also, in this case, it is necessary that the comparator 24 detects the voltage of several tens mV, as similar to FIGS. 12 and 13. FIG. 15 is a schematic circuit diagram of a signal detection circuit 10*e* according to yet another embodiment of the present disclosure. As shown in FIG. 15, a reference voltage line of the comparator 24 may include a dummy circuit including $R_7$~$R_{12}$, $C_5$~$C_8$, and $Q_4$~$Q_6$ that has the same structure as a filter line of the low-pass filter 23. Specifically, $R_1=R_7$, $R_2=R_8$, $R_3=R_9$, $R_4=R_{10}$, $R_5=R_{11}$, $R_6=R_{12}$, $C_1=C_5$, $C_2=C_6$, $C_3=C_7$, $C_4=C_8$, $Q_1=Q_4$, $Q_2=Q_5$, $Q_3=Q_6$, $I_1=I_4$, $I_2=I_5$, and $I_3=I_6$. If the dummy circuit including $R_7$~$R_{12}$, $C_5$~$C_8$, and $Q_4$~$Q_6$ is included, since an offset caused by the Sallen-key type low-pass filter can be canceled, it is possible to accurately detect the control signal from the ECU 7.

Figure 16:
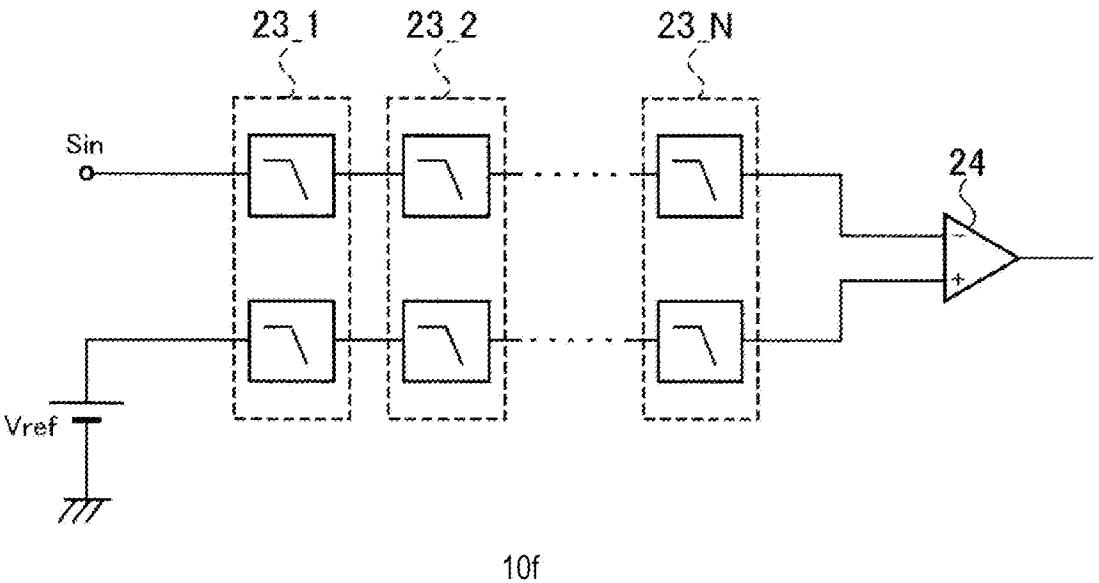
FIG. 16 is a schematic block diagram of a signal detection circuit according to yet another embodiment.

FIGS. 14 and 15 illustrate the Sallen-key type low-pass filter of two stages. However, it is possible that the number of stages of the Sallen-key type low-pass filter may be three or more. FIG. 16 is a schematic block diagram of a signal detection circuit 10*f* according to yet another embodiment of the present disclosure. As shown in FIG. 16, the signal detection circuit 10*f* may include a Sallen-key type low-pass filter having n stages 23_1, 23_2, . . . , and 23N.

(Floating Structure)

Figure 17:
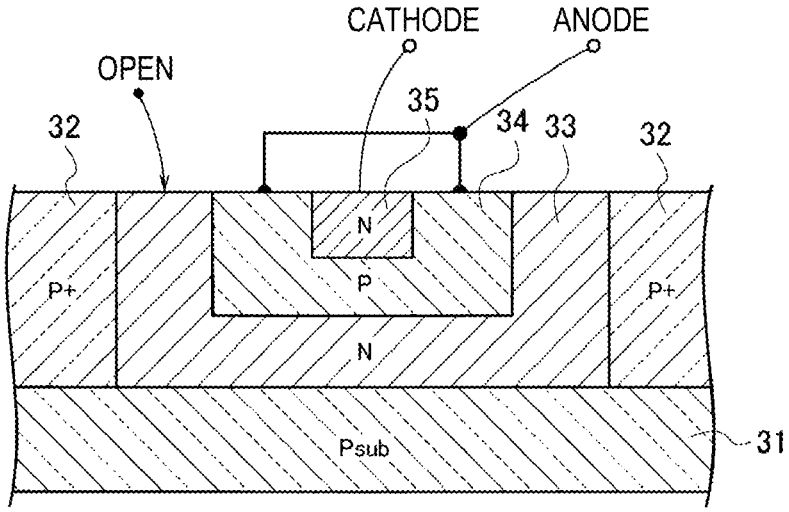
FIG. 17 is a schematic cross-sectional structure diagram of a floating structure according to the embodiment.

FIG. 17 shows a schematic cross-sectional structure of the floating structure according to the embodiment. As shown in FIG. 17, $P^+$ regions 32 are formed on a P type substrate 31, and an N type region 33 is formed between the P type substrate 31 and the $P^+$ regions 32. Also, a P type region 34 is formed within the N type region 33, and an N type region 35 is formed within the P type region 34. Further, an anode terminal is extracted from the P type region 34, a cathode terminal is extracted from the N type region 35, and the diode is formed by the PN junction of the P type region 34 and the N type region 35. The floating structure is formed by opening the N type region 33 formed under the diode.

First Example of Bidirectional Floating Diode

Figure 18A:
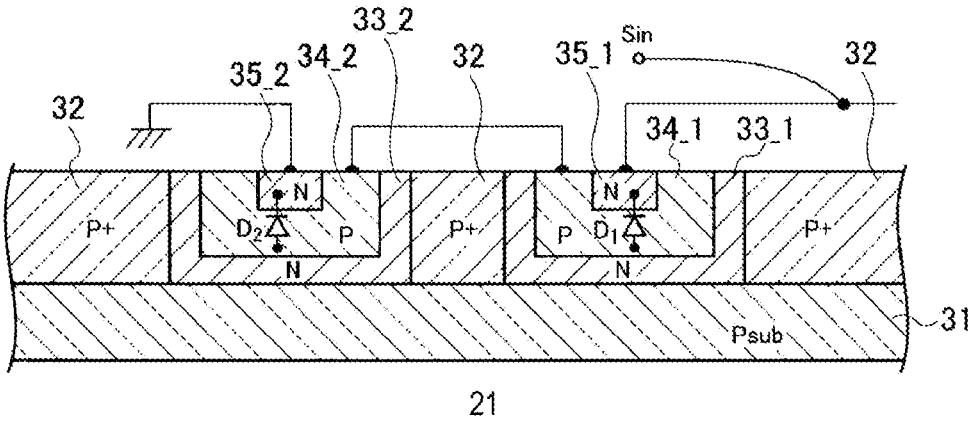
Figure 18B:
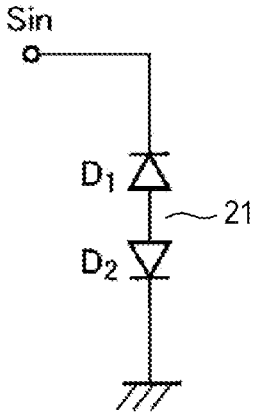

FIG. 18A shows a schematic cross-sectional structure of the bidirectional floating diode 21 according to the embodiment of the present disclosure. The bidirectional floating diode 21 includes floating diodes $D_1$ and $D_2$. The floating structure of the floating diodes $D_1$ and $D_2$ is the same as described with reference to FIG. 17. As shown in FIG. 18A, the input terminal Sin is connected to an N type region 35_1, a P type region 34_1 is connected to a P type region 34_2, and an N type region 35_2 is connected to the ground. Thus, the floating diode $D_1$ is formed by the PN junction of the P type region 34_1 and the N type region 35_1. Also, the floating diode $D_2$ is formed by the PN junction of the P type region 34_2 and the N type region 35_2. That is, as shown in FIG. 18B, the bidirectional floating diode 21 has a structure in which the anode of the floating diode $D_1$ and the anode of the floating diode $D_2$ are connected to each other.

Second Example of Bidirectional Floating Diode

Figure 19A:
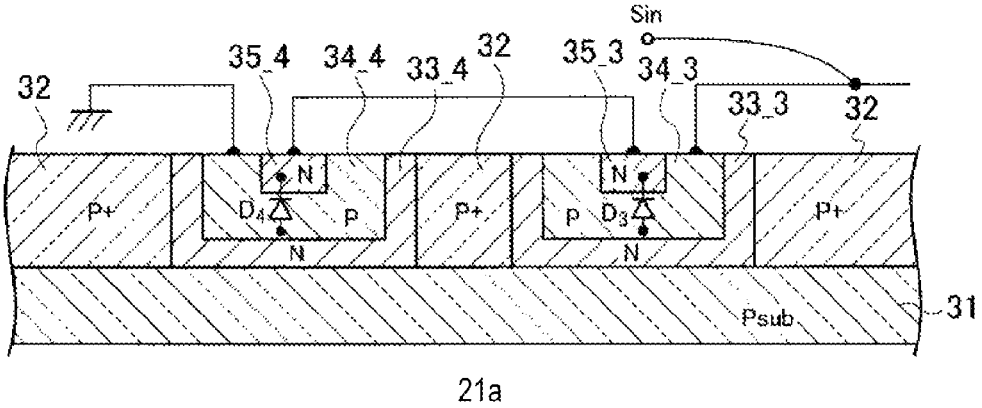
Figure 19B:
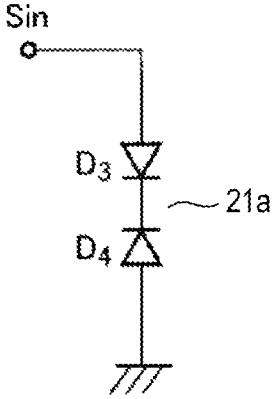

FIG. 19A shows a schematic cross-sectional structure of another bidirectional floating diode 212*a* according to the embodiment of the present disclosure. The bidirectional floating diode 212*a* includes floating diodes $D_3$ and $D_4$. The floating structure of the floating diodes $D_3$ and $D_4$ is the same as that of FIG. 18A. As shown in FIG. 19A, the input terminal Sin is connected to a P type region 34_3, an N type region 35_3 is connected to an N type region 35_4, and a P type region 34_4 is connected to the ground. Thus, the floating diode $D_3$ is formed by the PN junction of the P type region 34_3 and the N type region 35_3. Also, the floating diode $D_4$ is formed by the PN junction of the P type region 34_4 and the N type region 35_4. That is, as shown in FIG. 19B, the bidirectional floating diode 212*a* has a structure in which the cathode the floating diode $D_3$ and the cathode of the floating diode $D_4$ are connected to face each other.

(Waveform in Signal Detection Circuit)

Figure 20A:
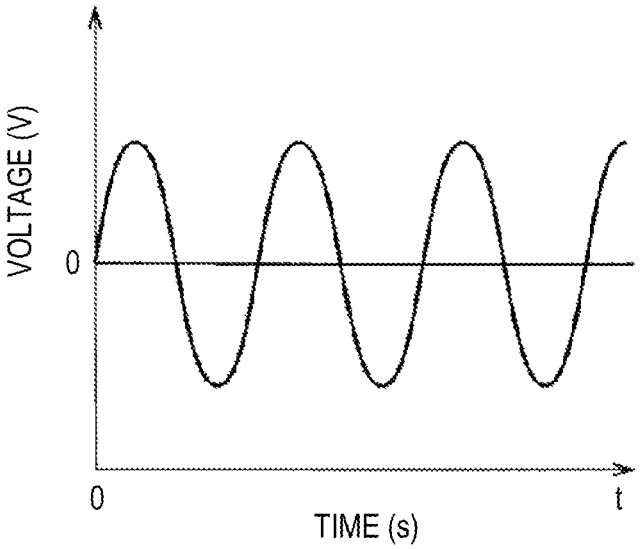
Figure 20B:
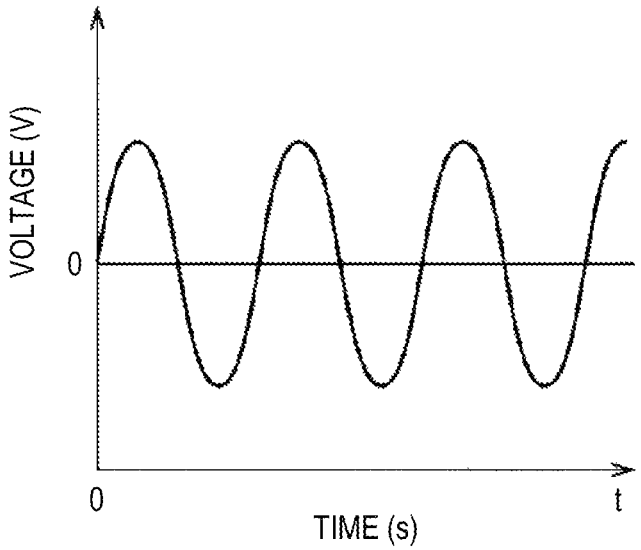
Figure 21A:
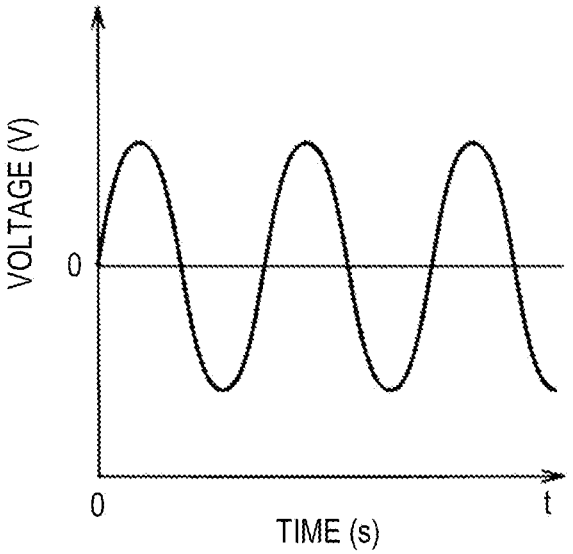
Figure 21B:
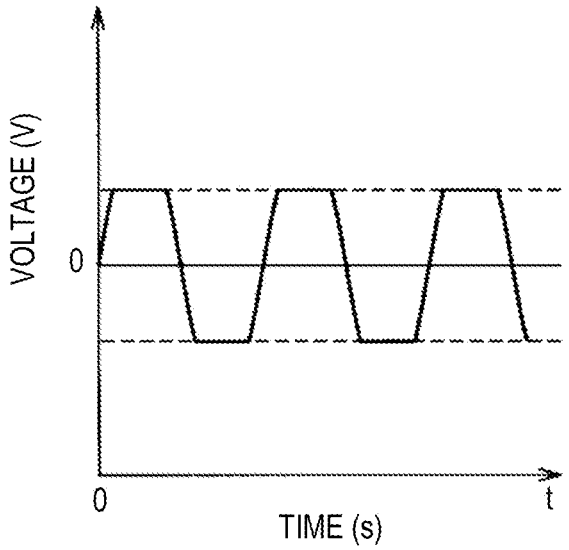

FIGS. 20A to 21B show schematic waveforms in the signal protection circuit 10 according to the embodiment of the present disclosure. That is, even if the noise as shown in FIG. 20A is applied, since the bidirectional floating diode 21 is used as the ESD protection element, the input signal Sin fluctuates at positive and negative sides as shown in FIG. 20B. If the input signal Sin is not clamped to the half-wave at the negative side, the capacitor C of the low-pass filter 23 can be charged and discharged in a balanced manner. Therefore, as shown in FIG. 21A, the envelope detection is not performed, and a high frequency is filtered by the low-pass filter 23. Thus, as shown in FIG. 21B, it is possible that the comparator 24 can accurately detect the control signal from the ECU 7.

Also, for example, FIG. 10 shows a configuration including the resistor $R_3$. However, it is possible that the resistor $R_3$ may be omitted in case of including the resistors $R_1$ and $R_2$.

In the above-described embodiments, the case where the diode having the floating structure is used as the ESD protection element is described. However, it is also possible to use a bipolar transistor having the floating structure as the ESD protection element.

Further, the example of using the IGBT as the switch element is described in the above-described embodiments. However, it is also possible to apply other power devices, for example, a SiC MOSFET, a GaN-based power device and the like, instead of the IGBT.

According to the embodiment of the present disclosure, since the bidirectional floating diode is used as the ESD protection element of the signal detection circuit, it is possible to enhance malfunction tolerance against the noise. Usually, a test is performed for a signal detection circuit, in which noise exceeding a practical value of an input signal to the signal detection circuit is superimposed to the input signal. However, it is very difficult to meet the test. Thus, it is necessary that various kinds of ideas for meeting the test are made, for example, by adding an additional component part, or narrowing a range of a design margin. However, according to the embodiment, it is not necessary to provide such an additional component part and the range of the design margin need not to be narrowed.

The signal detection circuit and the igniter according to the present disclosure may be used in various apparatus including an engine, for example, a vehicle, a motorcycle and the like.

As described above, according to the present disclosure, it is possible to provide a signal detection circuit and an igniter capable of enhancing the malfunction tolerance against the noise.

Figure 22:
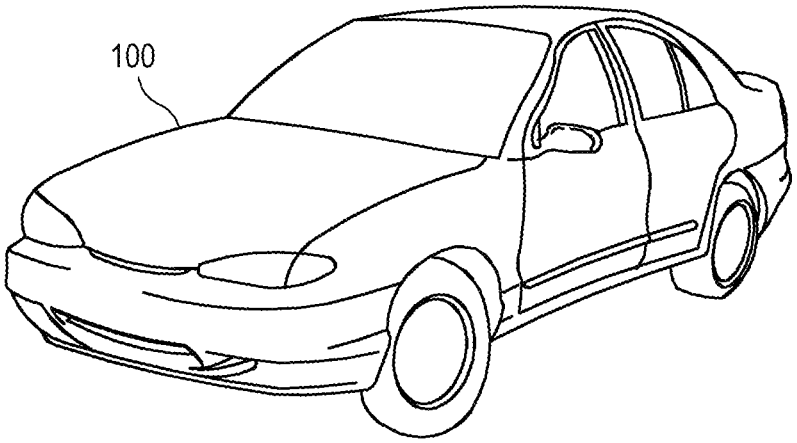
FIG. 22 is a perspective view showing a vehicle including the igniter of FIG. 1.

FIG. 22 is a perspective view showing a vehicle 100 including the igniter of FIG. 1.

While certain embodiments have been described, these embodiments have been presented by way of example only, and are not intended to limit the scope of the disclosures. Indeed, the novel methods and apparatuses described herein may be embodied in a variety of other forms; furthermore, various omissions, substitutions and changes in the form of the embodiments described herein may be made without departing from the spirit of the disclosures. The accompanying claims and their equivalents are intended to cover such forms or modifications as would fall within the scope and spirit of the disclosures.

What is claimed is:

1. A signal detection circuit for detecting a control signal from an engine control unit, comprising:

an input terminal configured to receive the control signal;

a bidirectional floating diode provided between the input terminal and a ground;

an attenuation circuit configured to attenuate a voltage of a connection point of the input terminal and the bidirectional floating diode;

a low-pass filter configured to pass a low-frequency component of an output of the attenuation circuit; and a comparator configured to compare an output of the low-pass filter with a reference voltage.

2. The signal detection circuit of claim 1, wherein the bidirectional floating diode comprises two diodes each having a floating structure and anodes of the two diodes are connected to each other.

3. The signal detection circuit of claim 1, wherein the bidirectional floating diode comprises two diodes each having a floating structure and cathodes of the two diodes are connected to each other.

4. The signal detection circuit of claim 2, wherein the floating structure is provided by forming an N-type region under a PN junction and maintaining the N-type region in an open state.

5. The signal detection circuit of claim 1, wherein positive and negative breakdown voltages of the bidirectional floating diode are the same with respect to the input terminal.

6. The signal detection circuit of claim 1, wherein the comparator includes a pair of NPN type bipolar transistors whose base terminals are connected together.

7. The signal detection circuit of claim 1, wherein the low-pass filter is a Sallen-key type low-pass filter having a predetermined number of stages.

8. The signal detection circuit of claim 7, wherein a reference voltage line of the comparator has a dummy circuit that has the same structure as a filter line of the low-pass filter.

9. An igniter for controlling an operation of a spark plug based on a control signal from an engine control unit, comprising:

a switch control unit having a signal detection circuit configured to detect the control signal;

an ignition coil configured to generate a voltage to be supplied to the spark plug; and a switch element configured to apply or cut current, which flows to the ignition coil, based on an output of the switch control unit, wherein the signal detection circuit includes a bidirectional floating diode for electrostatic protection.

10. The igniter of claim 9, wherein the bidirectional floating diode comprises two diodes each having a floating structure and anodes of the diodes are connected to each other.

11. The igniter of claim 9, wherein the bidirectional floating diode comprises two diodes each having a floating structure and cathodes of the two diodes are connected to each other.

12. The igniter of claim 11, wherein the floating structure is provided by forming an N-type region under a PN junction and maintaining the N-type region in an open state.

13. A vehicle comprising the igniter of claim 9.

* * * * *